US009707668B2

(12) United States Patent
Wu

(10) Patent No.: US 9,707,668 B2
(45) **Date of Patent: *Jul. 18, 2017**

(54) MULTI-MODE WRENCH

(71) Applicant: Yi-Min Wu, Taichung (TW)

(72) Inventor: Yi-Min Wu, Taichung (TW)

( * ) Notice: Subject to any disclaimer, the term of this patent is extended or adjusted under 35 U.S.C. 154(b) by 30 days.

This patent is subject to a terminal disclaimer.

(21) Appl. No.: 14/615,213

(22) Filed: Feb. 5, 2015

(65) Prior Publication Data

US 2016/0229035 A1 Aug. 11, 2016

(51) Int. Cl.
*B25B 13/46* (2006.01)
*B25B 13/48* (2006.01)

(52) U.S. Cl.
CPC ..... *B25B 13/463* (2013.01); *B25B 13/481* (2013.01)

(58) Field of Classification Search
CPC .... B25B 13/463; B25B 13/481; B25B 13/462
USPC ..... 81/60–63.2
See application file for complete search history.

(56) References Cited

U.S. PATENT DOCUMENTS 2,720,127 A * 10/1955 Bonniwell ..... B25B 13/463 81/63
5,174,176 A * 12/1992 Krivec ..... B25B 13/463 81/62
5,450,773 A * 9/1995 Darrah ..... B25B 21/004 81/57.39
6,209,423 B1 * 4/2001 Shiao ..... B25B 13/463 192/43.1
6,282,990 B1 * 9/2001 Miner ..... B25B 21/004 81/57.11
6,408,722 B1 * 6/2002 Chen ..... B25B 13/463 81/60
6,510,765 B2 * 1/2003 Mu-Lin ..... B25B 13/463 81/60
7,243,581 B1 * 7/2007 Gao ..... B25B 23/141 192/38
7,587,961 B1 * 9/2009 Chiang ..... B25B 13/468 81/60
8,475,466 B2 * 7/2013 Chenaux ..... A61B 17/8875 606/104
8,567,287 B2 * 10/2013 Gapp ..... B25B 13/08 81/60
2007/0107560 A1 * 5/2007 Chiang ..... B25B 13/465 81/63.2

(Continued)

*Primary Examiner* — Larry E Waggle, Jr.
*Assistant Examiner* — Danny Hong

(57) ABSTRACT

A multi-mode one-way wrench includes a head, a toothed wheel, a leading pawl, at least one following pawl and a switch. The head includes cutouts in communication with a chamber. The toothed wheel rests in the chamber and includes teeth. The pawls are movably rest in the cutouts and adapted for alternate engagement with the toothed wheel. The following pawl includes a stem. The switch rests on the head and made with at least one arched groove for receiving and guiding the stem to move the following pawl between a first mode for engagement with the toothed wheel and a second mode kept from the toothed wheel. The cutouts are biased from one another by an angle of 360°×(M+1/L)÷N, wherein L is an integer for representing the number of the cutouts, M is any proper integer, and N is an integer for representing the number of the teeth.

12 Claims, 6 Drawing Sheets

(56) References Cited

U.S. PATENT DOCUMENTS

2010/0269639 A1* 10/2010 Sroka ..... B25B 13/463
81/58.2

* cited by examiner

MULTI-MODE WRENCH

BACKGROUND OF INVENTION

1. Field of Invention

The present invention relates to a one-way wrench and, more particularly, to a multi-mode one-way wrench.

2. Related Prior Art

A one-way wrench (or "ratchet wrench") includes a head, a toothed wheel placed in the head, and a pawl placed in the head. The head can be rotated in an active direction to bring the pawl into engagement with the toothed wheel so that the head rotates the toothed wheel via the pawl. The head can be rotated in an idle direction to allow the pawl to rattle on the toothed wheel so that the head does not rotate the toothed wheel in the idle direction.

In operation, the toothed wheel is engaged with a nut for example. The head is rotated in the active direction to rotate the toothed wheel for an angle, and the head is rotated in the idle direction for an adequate angle before the head is rotated in the active direction again to rotate the wheel. This process is repeated so that the nut is engaged with a screw or removed from a screw. Such a one-way wrench is particularly useful in a limited space.

The head must be rotated in the idle direction for at least a minimum angle before the head can rotate the toothed wheel in the active direction again. The more the teeth of the toothed wheel are, the smaller the minimum angle is, i.e., the more convenient the operation of the one-way wrench is. For example, the minimum angle is 10° where the toothed wheel includes 36 teeth but only 5° where the toothed wheel includes 72 teeth. However, the more the teeth are, the smaller and hence weaker they are. It is difficult to increase the convenience without jeopardizing the strength in a conventional one-way wrench.

To reach a good balance between the convenience and strength, the applicant has invented a one-way wrench and filed applications such as European Patent Application No. 12195169.3, U.S. patent application Ser. No. 13/691,477, Japanese Patent Application No. 2013-170474, Chinese Patent Application No. 201210507001.6 and Taiwanese Patent Application No. 101139643.

Therefore, the present invention is intended to obviate or at least alleviate the problems encountered in prior art.

SUMMARY OF INVENTION

It is the primary objective of the present invention to provide a multi-mode one-way wrench.

To achieve the foregoing objective, the multi-mode one-way wrench includes a head, a toothed wheel, a leading pawl, at least one following pawl and a switch. The head includes cutouts in communication with a chamber. The toothed wheel rests in the chamber and includes teeth. The pawls are movably rest in the cutouts and adapted for alternate engagement with the toothed wheel. The following pawl includes a stem. The switch rests on the head and made with at least one arched groove for receiving and guiding the stem to move the following pawl between a first mode for engagement with the toothed wheel and a second mode kept from the toothed wheel. The cutouts are biased from one another by an angle of $360° \times (M+1/L) \div N$, wherein L is an integer for representing the number of the cutouts, M is any proper integer, and N is an integer for representing the number of the teeth.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
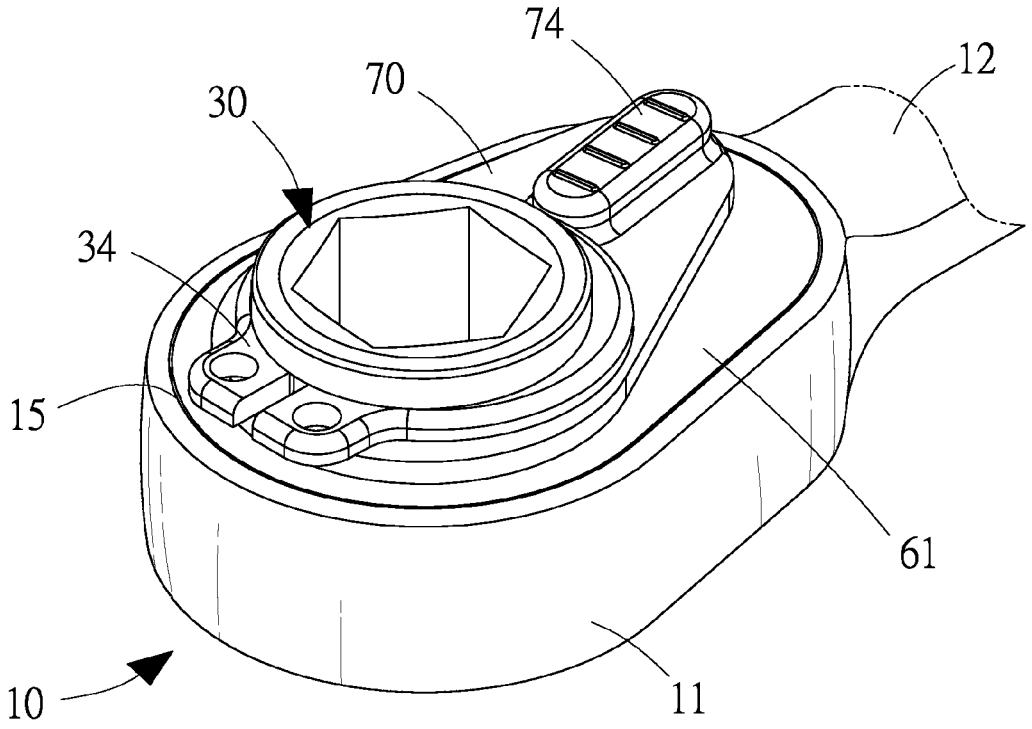
FIG. 1 is a perspective view of a convenient and strong multi-mode one-way wrench according to the preferred embodiment of the present invention.
Figure 2:
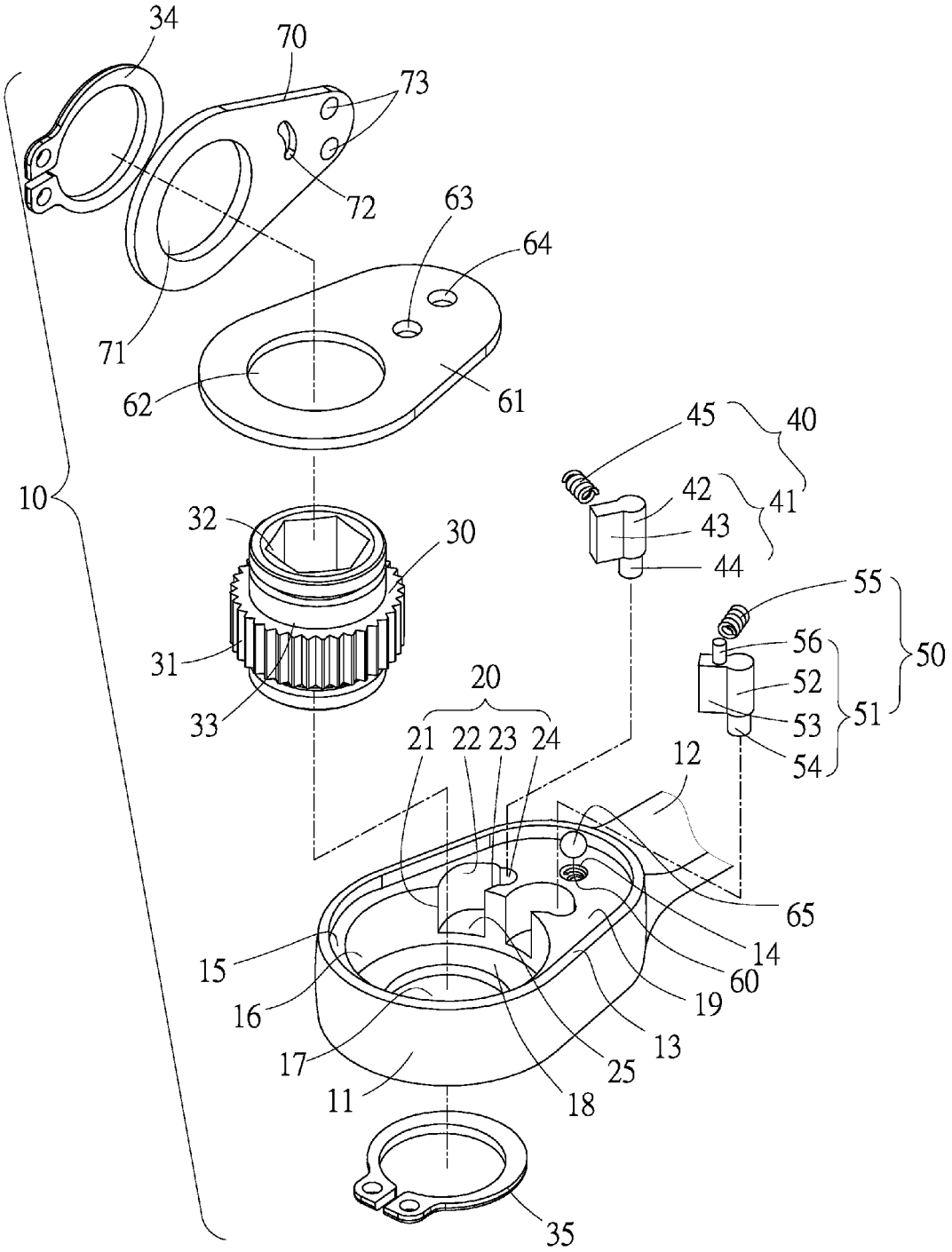
FIG. 2 is an exploded view of the multi-mode one-way wrench shown in FIG. 1.
Figure 3:
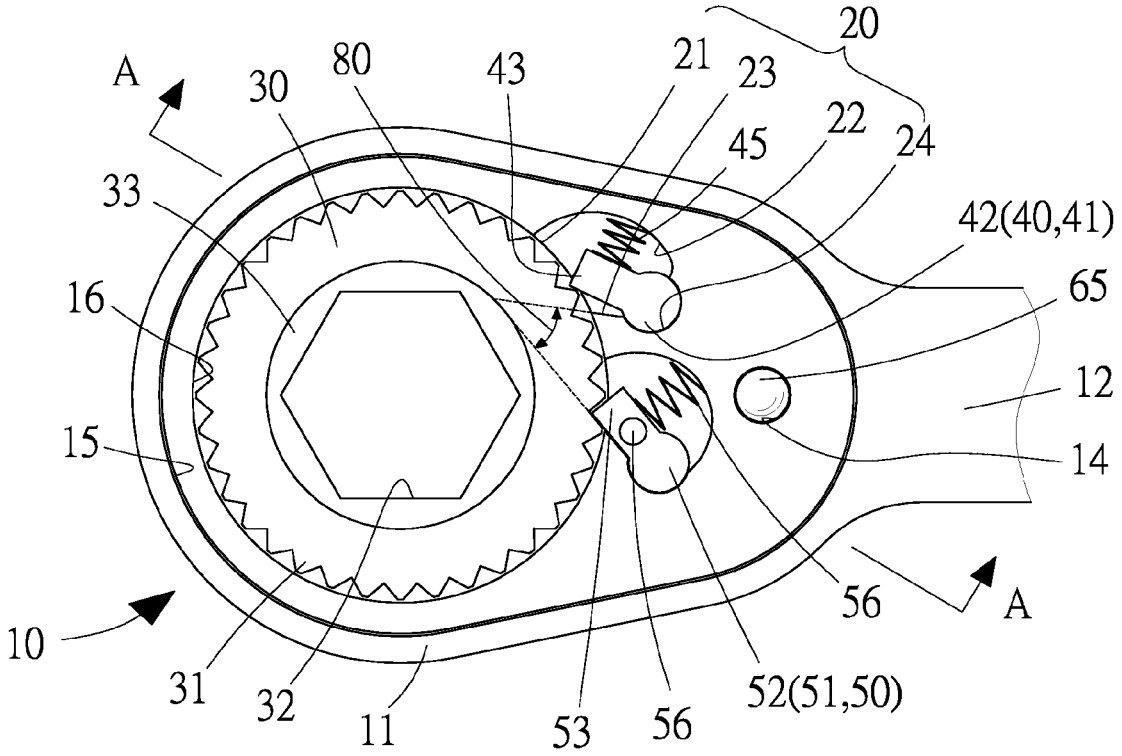
FIG. 3 is a top view of the multi-mode one-way wrench shown in FIG. 1, with a cover removed.
Figure 4:
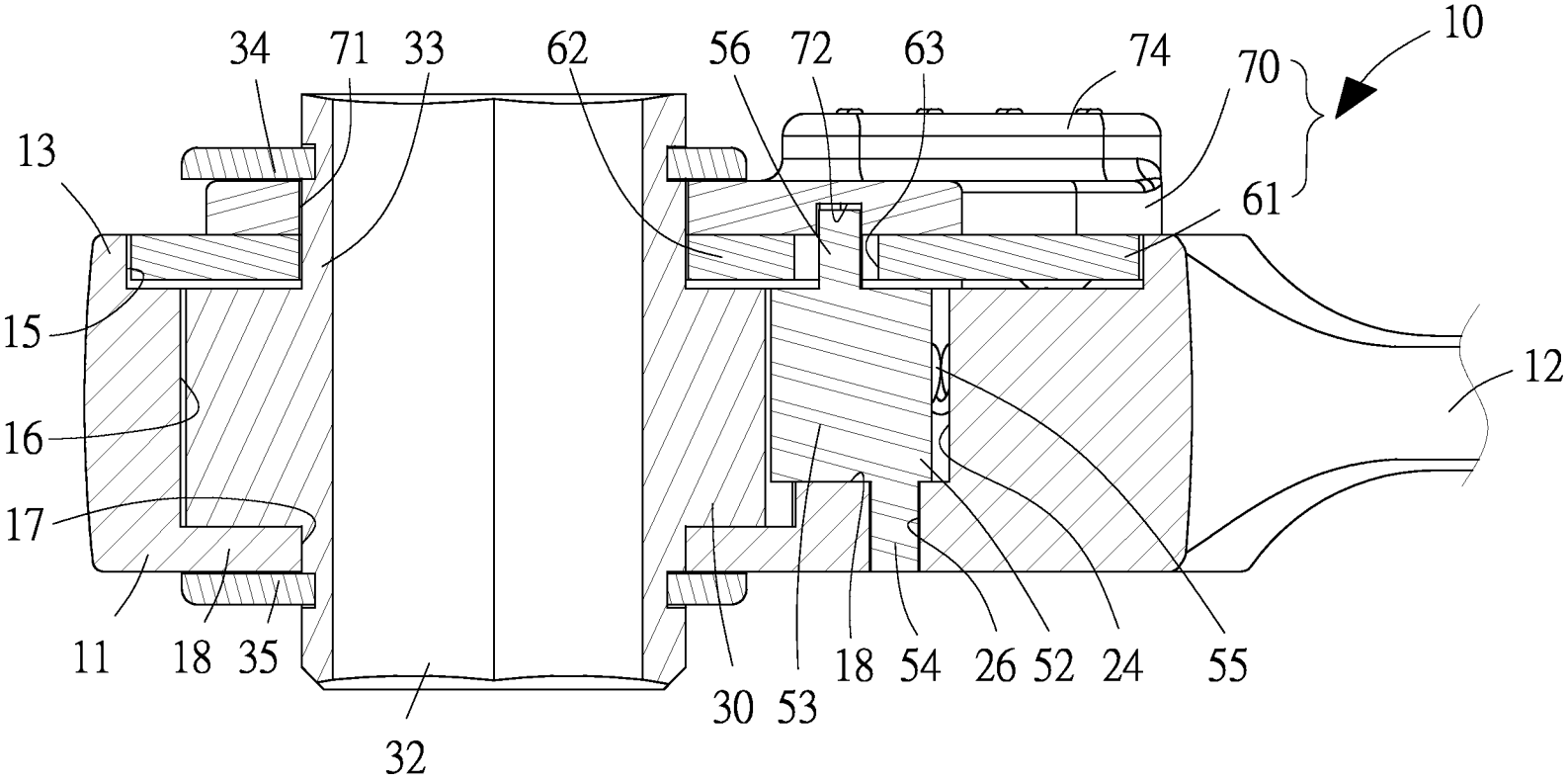
FIG. 4 is a cross-sectional view of the multi-mode one-way wrench shown in FIG. 1.

Referring to FIGS. 1 and 2, a multi-mode one-way wrench 10 includes a head 11, a handle 12, a toothed wheel 30, two pawl units 40 and 50, a cover 61 and a switch 70 according to the preferred embodiment of the present invention. The head 11 is formed at an end of the handle 12. It should be noted that there is no clear borderline between the head 11 and the handle 12 since they are made one. The head 11 includes a wall 13 extending on a planar face 19 and extending around a shallow cavity 15.

The head 11 further includes a circular chamber 16 made in the planar face 19, a circular opening 17 made in an annular flange 18 extending from the wall of the circular chamber 16, and a bore 14 made in the planar face 19. The shallow cavity 15, the circular chamber 16 and the circular aperture are in communication with one another.

The head 11 further includes two cutouts 20 each formed with an opening 21, an arched face 22, a vertical planar face 23, a sub-cutout 24, a floor 25 and a bore 26. The opening 21 is made between arched face 22 and the vertical planar face 23. Each cutout 20 is in communication with the circular chamber 16 via the opening 21. Both of the arched face 22 and the vertical planar face 23 extend on the floor 25. The sub-cutout 24 is made between the arched face 22 and the planar face 23. The bore 26 is made in the floor 25. For clarity, one of the cutouts 20 will be referred to as the "first cutout 20" and the other cutout 20 the "second cutout 20" in the following description.

The toothed wheel 30 is formed with two axles 33, teeth 31 and a non-circular aperture 32. One of the axles 33 (the "lower axle") extends from a lower side of the toothed wheel 30 while the other axle 33 (the "upper axle") extends from an upper side of the toothed wheel 30. The teeth 31 extend from the periphery of a middle portion of the toothed wheel 30 in a radial manner. The non-circular aperture 32 axially extends throughout the toothed wheel 30 including the axle 33. The non-circular aperture 32 can receive a nut or a head of a threaded bolt in use.

In another embodiment, the non-circular aperture 32 can be replaced with a non-circular insert for insertion in a corresponding bore made in a tool bit (not shown) that in turn can receive a nut or a head of a threaded bolt in use.

The second cutout 20 is biased from the first cutout 20 by an angle θ regulated by the following equation:

$$\theta=360°\times(M+½)/N;$$

wherein N is an integer that represents the number of the teeth 31 and M is any proper integer.

In the preferred embodiment, there are thirty-six (36) identical teeth 31. Hence, each tooth 31 covers 10°. The angle θ between the first and second cutouts 20 is 35° for example.

The pawl unit 40 includes a pawl 41 and a spring 45. The pawl 41 includes a key 43 extending, in a radial direction, from an axle 42 made with a reduced end 44.

The pawl unit 50 includes a pawl 51 and a spring 55. The pawl 51 includes a key 53 extending, in a radial direction, from an axle 52 made with a reduced end 54. The pawl 51 is identical to the pawl 41 except for including an additional stem 56 extending upwards from the key 53.

The cover 61 is made with a circular opening 62 and two apertures 63 and 64. The cover 61 is made in compliance with the shallow cavity 15.

The switch 70 is a flat element. The switch 70 includes a circular opening 71, an arched groove 72, two recesses 73 made in a lower face, and a ridge 74 formed on an upper face.

The toothed wheel 30 is placed in the circular chamber 16. The middle portion of the toothed wheel 30, on and around which the teeth 31 are formed, is supported on the annular flange 18. The lower axle 33 extends out of the head 11 through the circular opening 17. The annular flange 18 is used as a bearing for the lower axle 33. The upper axle 33 extends out of the head 11 through the shallow cavity 15.

The pawl 41 and the spring 45 are placed in the first cutout 20. The axle 42 is inserted in the sub-cutout 24 of the first cutout 20. The reduced lower end 44 is inserted in the bore 26 of the first cutout 20 so that the pawl 41 is allowed to pivot. The spring 45 is compressed between the key 43 and the arched wall 22 of the first cutout 20. Thus, the spring 45 tends to push the key 43 into engagement with at least one of the teeth 31, out of the opening 21 of the first cutout 20.

The pawl 51 and the spring 55 are placed in the second cutout 20. The axle 52 is inserted in the sub-cutout 24 of the second cutout 20. The reduced lower end 54 is inserted in the bore 26 of the second cutout 20 so that the pawl 51 is allowed to pivot. The spring 55 is compressed between the key 53 and the arched wall 22 of the second cutout 20. Thus, the spring 55 tends to push the key 53 into engagement with at least one of the teeth 31, out of the opening 21 of the second cutout 20. The stem 56 extends out of the second cutout 20.

A spring 60 and a ball 65 are placed in the bore 14. The spring 60 is compressed between the ball 65 and a closed end of the bore 14. Thus, the spring 60 tends to push the ball 65 out of an open end of the bore 14.

The cover 61 is supported on the head 11. The cover 61 is placed in the shallow cavity 15 and confined by the wall 13. The circular opening 62 is aligned with the circular chamber 16 to allow the upper axle 33 to extend beyond the cover 61 via the circular opening 62. The cover 61 is used as a bearing for the upper axle 33. The aperture 63 is aligned with the second cutout 20 to allow the stem 56 to extend beyond the cover 61 via the aperture 63. The aperture 63 is made of a diameter larger than that of the stem 56 to allow the stem 56 to move in the aperture 63. The aperture 64 is aligned with the bore 14 to allow the ball 65 to extend beyond the cover 61 via the aperture 64.

The switch 70 is placed on the cover 61. The circular opening 71 is aligned with the circular opening 62 to allow the upper axle 33 to extend beyond the switch 70 through the circular opening 71. One of the recesses 73 receives the ball 65. The arched groove 72 receives the tip of the stem 56.

A C-clip 34 is engaged with the upper axle 33. Another C-clip 35 is engaged with the lower axle 33. Thus, all of the elements are kept in position.

Figure 5:
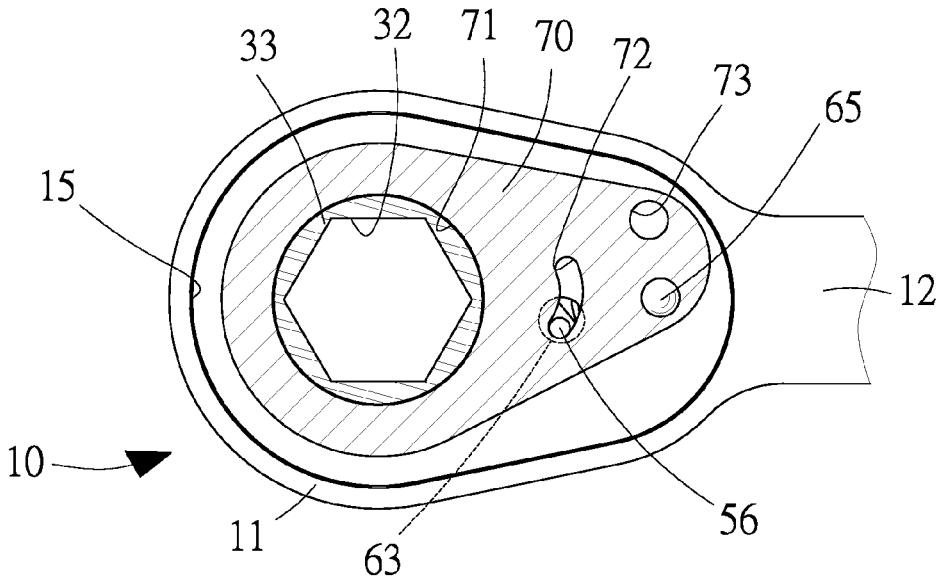
FIG. 5 is a top view of the multi-mode one-way wrench shown in FIG. 1.
Figure 6:
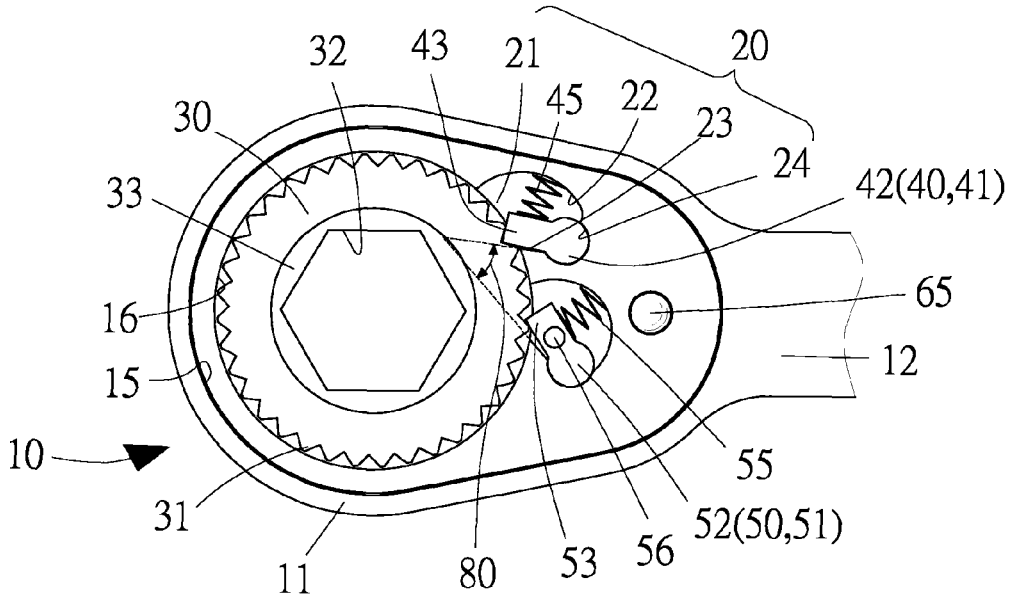
FIG. 6 is a top view of the multi-mode one-way wrench shown in FIG. 5, with the cover removed.

Referring to FIGS. 5 and 6, the multi-mode one-way wrench 10 is placed in a half-tooth mode as the switch 70 is placed in a first position. One of the recesses 73 receives the ball 65 to keep the switch 70 in the first position and the multi-mode one-way wrench 10 in the half-tooth mode in an elastic manner.

In the half-tooth mode, the key 53 of the pawl 51 is allowed to pivot while the stem 56 is allowed to move in the arched groove 72. Hence, the key 53 of the pawl 51 is allowed to engage with and disengage from the teeth 31.

The key 43 of the pawl 41 is in contact with a tail side of a tooth 31. The head 11 and the handle 12 are pivoted counterclockwise. The head 11 rotates the toothed wheel 30 since the head 11 pushes the pawl 41 and the pawl 41 pushes the tooth 31. The key 53 of the pawl 51 is in contact with a leading side of another tooth 31.

Then, the handle 12 can be pivoted clockwise. Thus, the key 43 of the pawl 41 slides on the leading side of a tooth 31 while the key 53 of the pawl 51 slides on the leading side of another tooth 31.

After the head 11 is pivoted clockwise for as small as half of the angle θ of one tooth 31, i.e., 5°, the head 11 can be pivoted counterclockwise again to bring the key 53 of the pawl 51 into contact with the tail side of a tooth 31. Thus, the head 11 can rotate the toothed wheel 30.

The above-mentioned process can be repeated to bring the key 43 of the pawl 41 back into contact with the tail side of a tooth 31 and return the key 53 of the pawl 51 into contact with the leading side of another tooth 31. That is, the pawls 41 and 51 are alternately used to rotate the toothed wheel 30. The idle stroke, i.e., the clockwise rotation of the head 11 can be as small as half of the angle θ of one tooth 31, i.e., 5°.

Figure 7:
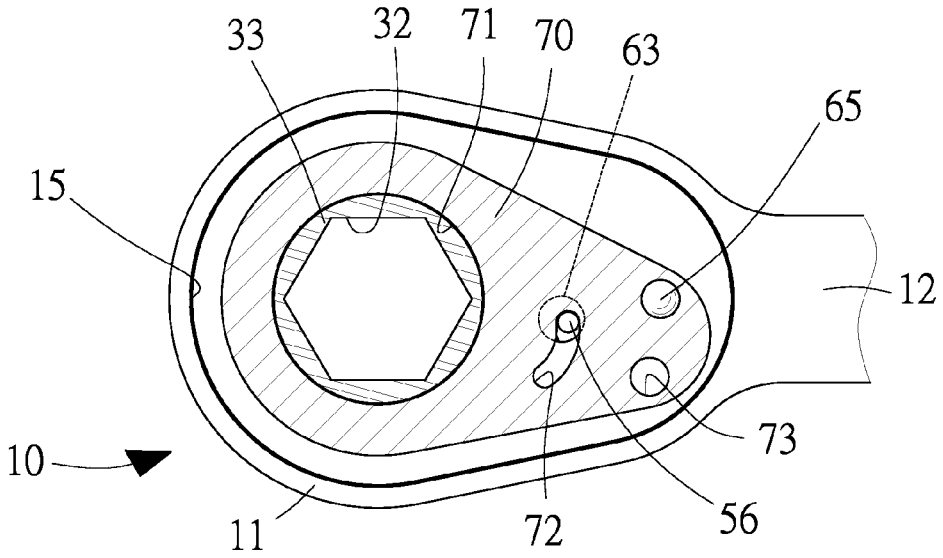
FIG. 7 is a top view of the multi-mode one-way wrench in another position than shown in shown in FIG. 5.
Figure 8:
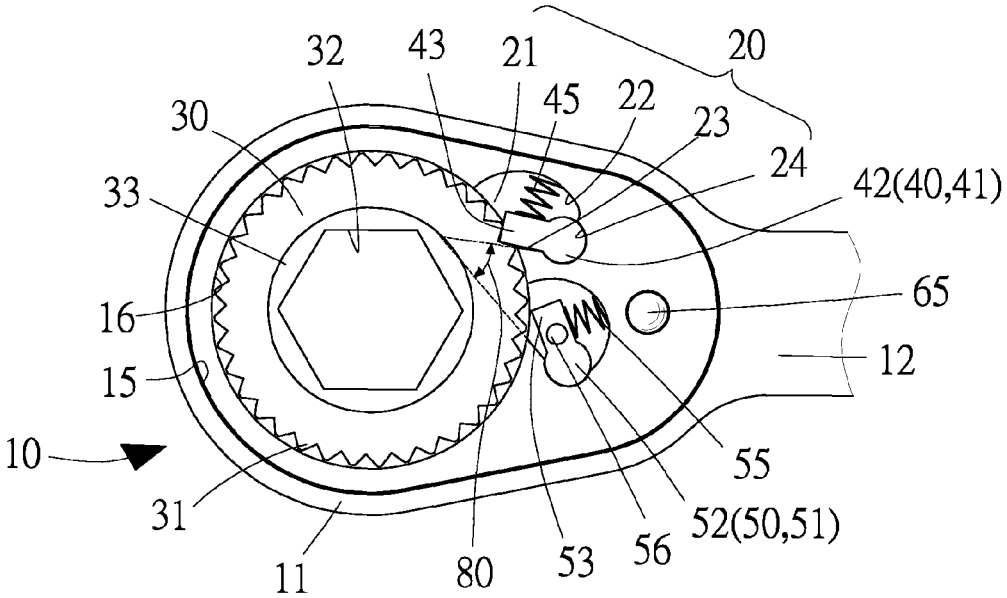
FIG. 8 is a top view of the multi-mode one-way wrench shown in FIG. 7, with the cover removed.

Referring to FIGS. 7 and 8, the multi-mode one-way wrench 10 is placed in a one-tooth mode as the switch 70 is placed in a second position. The other recess 73 receives the ball 65 to retain the switch 70 in the second position and the multi-mode one-way wrench 10 in the one-tooth mode in an elastic manner.

In the one-tooth mode, the key 53 of the pawl 51 is prevented from contacting any tooth 31 since the stem 56 is restrained by the arched groove 72. Only the key 43 of the pawl 41 is allowed to contact the teeth 31. The key 43 of the pawl 41 is in contact with the tail side of a tooth 31. The head 11 can be pivoted clockwise to rotate the toothed wheel 30 because the head 11 pushes the pawl 41 and the key 43 of the pawl 41 pushes the tail side of the tooth 31.

Then, the handle 12 can be pivoted clockwise. Thus, the key 43 of the pawl 41 slides on the leading side of a tooth 31 while the key 53 of the pawl 51 slides on the leading side of another tooth 31.

After the head 11 is pivoted clockwise for as small as the angle θ of one tooth 31, i.e., 10°, the head 11 can be pivoted counterclockwise again to bring the key 43 of the pawl 41 back into contact with the tail side of a tooth 31. Thus, the head 11 can rotate the toothed wheel 30.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A multi-mode one-way wrench including: a head made with a chamber and cutouts in communication with the chamber, wherein each of the cutouts comprises a sub-cutout made in a wall thereof; a toothed wheel rotationally placed in the chamber and formed with teeth; pawls for alternate engagement with the toothed wheel and each comprising an axle pivotally placed in the sub-cutout of a corresponding one of the cutouts, wherein the pawls include a leading pawl and at least one following pawl formed with a stem; and a switch placed on the head and made with at least one arched groove for receiving and guiding the stem to move the following pawl between a first mode for engagement with the toothed wheel and a second mode kept from the toothed wheel, wherein the cutouts are biased from one another by an angle of $360° \times (M+I/L) - \hat{}N$, wherein L is an integer for representing the number of the cutouts, M is any proper integer, and N is an integer for representing the number of the teeth.

2. The multi-mode one-way wrench according to claim 1, wherein the stem is movable along the arched groove when the following pawl rattles on the teeth of the toothed wheel in the second mode.

3. The multi-mode one-way wrench according to claim 1, including springs each placed in a corresponding one of the cutouts to bias the corresponding pawl toward the toothed wheel.

4. The multi-mode one-way wrench according to claim 1, wherein each of the cutouts includes a floor and a bore made in the floor, wherein the axle of each of the pawls includes a reduced end inserted in the bore of the corresponding cutout.

5. The multi-mode one-way wrench according to claim 1, wherein each of the cutouts includes a vertical face extending next to the sub-cutout, wherein the vertical face pushes a key of a corresponding pawl which in turn pushes a tooth of the toothed wheel.

6. The multi-mode one-way wrench according to claim 1, wherein each of the pawls includes a key extending from the axle in a radial direction, wherein the key is adapted for engagement with the teeth of the toothed wheel.

7. The multi-mode one-way wrench according to claim 6, wherein the stem extends from the key of the following pawl.

8. The multi-mode one-way wrench according to claim 1, wherein the switch is pivotally connected to the head.

9. The multi-mode one-way wrench according to claim 1, including a cover connected to the head to keep the toothed wheel in the head and the switch on the head.

10. The multi-mode one-way wrench according to claim 9, wherein the cover is placed between the head and the switch.

11. The multi-mode one-way wrench according to claim 10, wherein the cover includes an aperture via which the stem extends into the arched groove.

12. The multi-mode one-way wrench according to claim 1, including a handle extending from the head.

* * * * *